US006247904B1

(12) United States Patent
Miyazaki et al.

(10) Patent No.: US 6,247,904 B1
(45) Date of Patent: Jun. 19, 2001

(54) OIL PUMP APPARATUS

(75) Inventors: Hisashi Miyazaki, Toyoto; Yoshinori Miura, Kariya; Ichiro Kimura, Nagoya; Kongo Aoki, Toyota, all of (JP)

(73) Assignee: Aisin Seiki Kabushiki Kaisha, Aichi-Pref (JP)

( * ) Notice: Subject to any disclaimer, the term of this patent is extended or adjusted under 35 U.S.C. 154(b) by 0 days.

(21) Appl. No.: 09/435,777

(22) Filed: Nov. 8, 1999

Related U.S. Application Data

(62) Division of application No. 09/066,565, filed on Apr. 27, 1998, now Pat. No. 6,004,111.

(30) Foreign Application Priority Data

Apr. 28, 1997 (JP) ..... 9-11148
May 21, 1997 (JP) ..... 9-13145

(51) Int. Cl.[7] ..... F04B 49/00; F04B 23/00
(52) U.S. Cl. ..... 417/310; 417/440
(58) Field of Search ..... 417/310, 440, 417/304

(56) References Cited

U.S. PATENT DOCUMENTS 4,443,161 * 4/1984 Masuda et al. ..... 417/310
4,473,341 * 9/1984 Ohe et al. ..... 417/310
6,004,111 * 12/1999 Miyasaki et al. ..... 417/310

* cited by examiner

*Primary Examiner*—Timothy S. Thorpe
*Assistant Examiner*—Michael K. Gray
(74) *Attorney, Agent, or Firm*—Reed Smith Hazel & Thomas LLP

(57) ABSTRACT

An oil pump apparatus which includes an oil pump for being driven by a driving source and for being connected to a plurality of components to which an oil is supplied from the oil pump and a control valve preventing the oil which is unnecessary to the components from flowing into the components, wherein at least one of the components is an actuator operated by an oil pressure generated by the oil pump and wherein the control valve permits the oil of which the quantity is smaller than that of the oil which is consumed by the actuator to flow into the components when the actuator is not operated and the control valve permits the oil of which the quantity is larger than that of the oil which is consumed by the actuator to flow into the components when the actuator is operated.

3 Claims, 12 Drawing Sheets

OIL PUMP APPARATUS

This application is a Divisional of nonprovisional application Ser. No. 09/066,565 filed Apr. 27, 1998, which issued as U.S. Pat. No. 6,004,111.

BACKGROUND OF THE INVENTION

1. Field of the Invention

The present invention generally relates to an oil pump apparatus including an oil pump and a control valve for controlling the flow of oil back to a suction port of the oil pump.

2. Description of the Prior Art

A conventional oil pump apparatus installed on a vehicle engine is disclosed in Japanese Utility Model laid open No. 61 (1986)-23485. The oil pump apparatus disclosed in this publication includes an oil pump and a control valve through which flows a portion of oil (a portion of the oil exceeding the quantity of the oil consumed at a component to which the oil is supplied) pumped out from the oil pump back to a suction port of the oil pump, an oil pan, an oil reservoir, an oil tank and so on, in order to reduce a load applied to the oil pump at a medium and high rotation speed ranges of the oil pump.

In accordance with the above device, when a plurality of components, at least one of which is an actuator operated by the oil pressure generated by the oil pump (e.g., an actuator applied to a variable valve timing mechanism or a variable valve lift mechanism of the engine) are connected to the oil pump, only the excess oil exceeding the quantity of the oil consumed at all components (including an operating actuator) is returned to the suction port of the oil pump even though the actuator is not operated. Therefore, a large amount of the oil which is unnecessary to the components is supplied to the components when the actuator is not operated.

SUMMARY OF THE INVENTION

The present invention provides an oil pump apparatus which prevents excess oil which is unnecessary to the components from flowing into the components. The present invention also provides an oil pump apparatus which is small in size and light in weight. The present invention can be basically described as an oil pump apparatus comprising an oil pump for being driven by a driving source and for being connected to a plurality of components to which an oil is supplied from the oil pump and a control valve for preventing the oil which is unnecessary to the components from flowing into the components, wherein at least one of the components is an actuator operated by oil pressure generated by the oil pump. In this invention the control valve permits an amount of oil, of which the quantity is smaller than that of the oil which is consumed by the actuator, to flow into the components when the actuator is not operated. When the actuator is operated, the control valve permits an amount of oil, of which the quantity is larger than that of the oil which is consumed by the actuator to flow into the components.

BRIEF DESCRIPTION OF THE DRAWINGS

The features and advantages of the oil pump apparatus according to the present invention will be more clearly appreciated from the following description in conjunction with the accompanying drawings wherein.

DETAILED DESCRIPTION OF THE INVENTION

Figure 1:
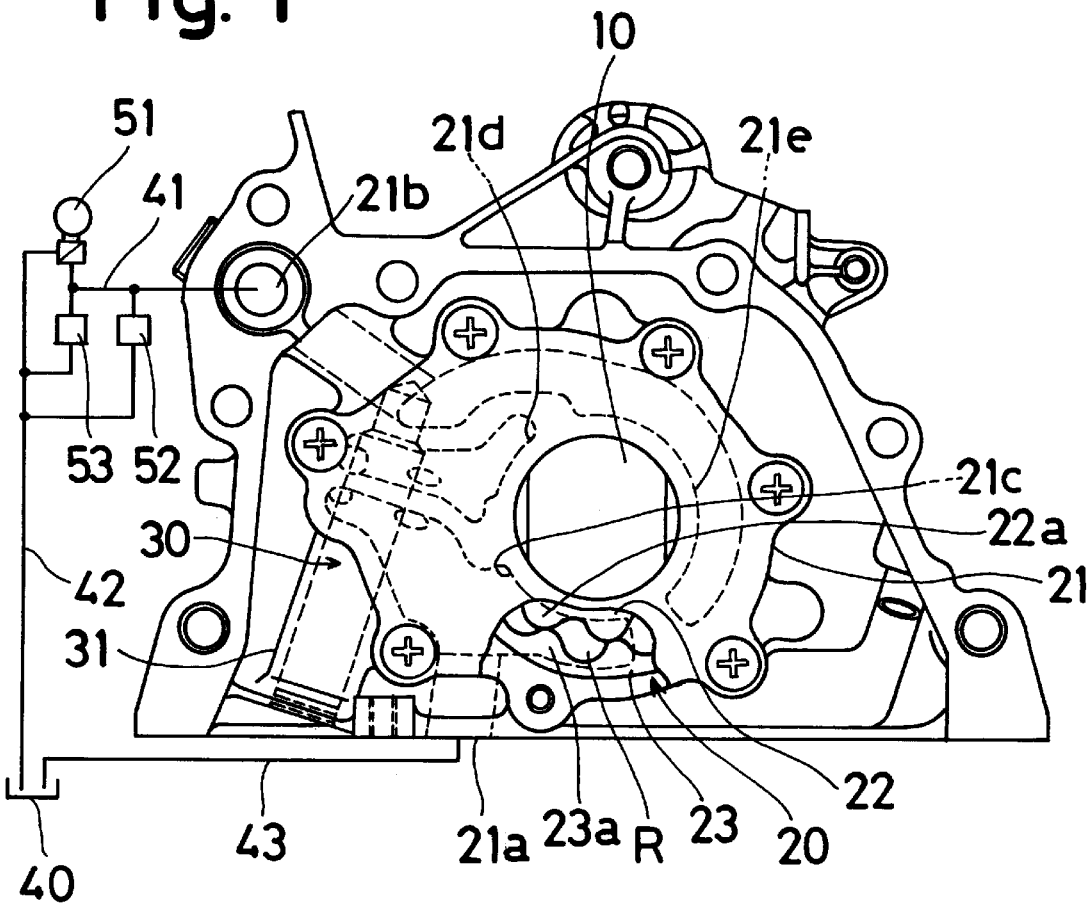
FIG. 1 is a view illustrating the oil pump apparatus of the invention.

As shown in FIG. 1, an oil pump apparatus comprises an oil pump 20 (which is a partially cut-away view) which is driven by a crank shaft 10 of a vehicle engine (not shown in Figures), and a control valve 30 which returns a portion of the operational oil pumped out from the oil pump 20 to a suction opening of the oil pump 20.

The oil pump 20 pumps the operational oil to a plurality of components through a discharge conduit 41. These components comprise an actuator 51 of a variable valve timing mechanism of the vehicle engine which is operated by the oil pressure, a lubrication portion 52 of the vehicle engine (e.g. a bearing) and a portion 53 of the vehicle engine to be cooled (e.g. cylinders and pistons). A drain conduit 42 connects the components 51, 52 and 53 to an oil pan 40 of the vehicle engine.

The crank shaft 10 rotates the oil pump 20 in the counter-clockwise direction. The oil pump 20 includes a pump housing 21, an inner rotor 22 rotatably installed in the pump housing 21 so as to be rotated by the crank shaft 10 and an outer rotor 23 eccentrically disposed in the pump housing 21 relative to the inner rotor 22. The outer rotor 23 includes inner teeth 23*a* which are engaged with the outer teeth 22*a* of the inner rotor 22 so as to be rotated by the inner rotor 22 in the same direction as the rotation of the inner rotor 22. The outer teeth 22*a* and, the inner teeth 23*a* are designed in a trochoid curve or a cycloid curve shape.

The oil pump 20 includes a suction opening 21*a* connected to the oil pan 40 through a suction conduit 43, a discharge opening 21*b* connected to the discharge conduit 41, a main suction port 21*c* constantly connected to the suction opening 21*a*, a sub-suction port 21*d* selectively connected to or disconnected from the main suction port 21*c* by the control valve 30 and a discharge port 21*e* constantly connected to the discharge opening 21*b*. The ports 21*c*, 21*d* and 21*e* are separated and disconnected from each other by a plurality of pump chambers R disposed between each pair of outer teeth 22*a* and each corresponding pair of inner teeth 23*a*.

Figure 2:
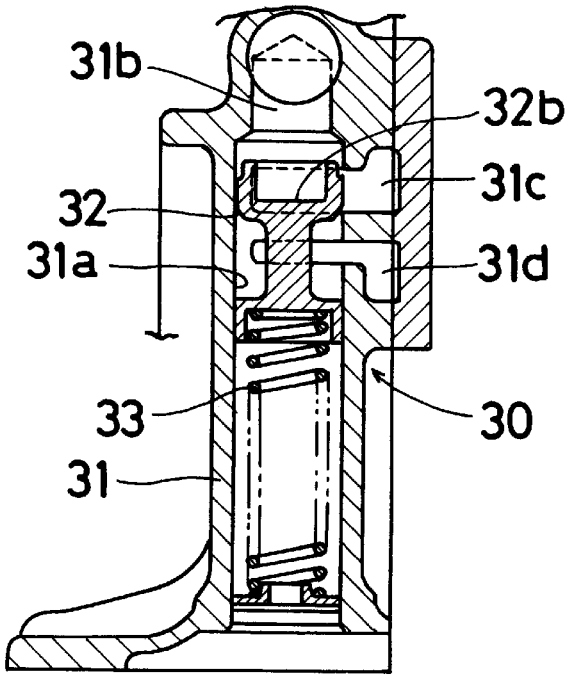
FIG. 2 is an enlarged cross-sectional view illustrating the control valve shown in FIG. 1.
Figure 3:
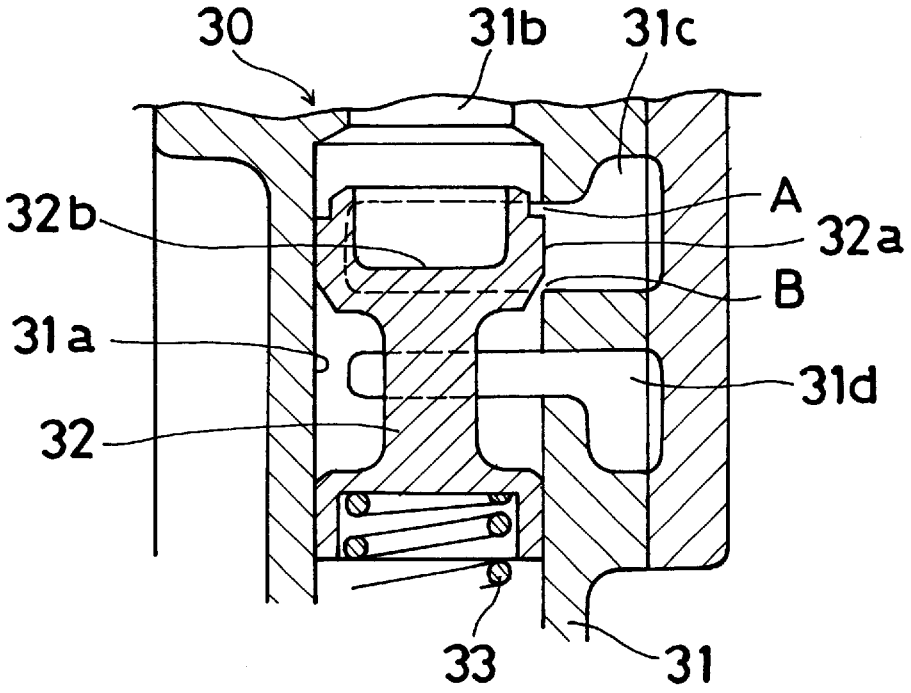
FIG. 3 is an enlarged detailed cross-sectional view illustrating the control valve of the present invention.

As shown in FIGS. 2 and 3, the control valve 30 includes a valve housing 31 having a cylinder 31*a*, a control port 31*b*, a sub-port 31*c* and a main port 31*d*. The control valve 30 also includes a valve spool 32 slidably disposed in the cylinder 31*a*. Oil pressure generated by the oil pump 20 is applied at the upper-end of valve spool 32 against the end portion 32*b* through the control port 31*b*, so as to control connections between the ports 31*b*, 31*c* and 31*d*. The control valve 30 further includes a spring 33 biasing the valve spool 32 in the upper direction shown in FIG. 2. The valve spool 32 is pushed downward within cylinder 31*a*, against the biasing force of spring 33, in proportion to the amount of oil pressure applied through the control port 31*b*. The valve spool 32 includes variable restriction portions A and B (shown in FIG. 3), which variably restrict the flow of oil through their respective restrictive portions, the degree of restriction determined by the position of the valve spool 32 within the cylinder 31*a*.

The control port 31*b* is constantly connected to the discharge port 21*e*, the sub-port 31*c* is constantly connected to the sub-suction port 21*d* and the main port 31*d* is constantly connected to the main suction port 21*c* of the oil pump 20. Since chamber 31*a* in which the spring 33 is installed is constantly connected to the oil pan 40, no oil pressure is generated which would force the valve spool 32 in the upward direction.

In accordance with this embodiment of the present invention, when the oil pressure applied to the control port 31*b* from the oil pump 20 ascends to a first predetermined value, the valve spool 32 is moved in the downward direction against the biasing force of the spring 33 so as to locate at a position (shown in FIG. 4) at which the valve spool 32 still disconnects the control port 31*b* from the sub-port 31*c* (first condition).

When the oil pressure applied to the control port 31*b* from the oil pump 20 ascends to a second predetermined value (which is larger than the first predetermined value), the valve spool 32 is moved against the biasing force of the spring 33 so as to locate at a position (shown in FIG. 5) at which the valve spool 32 still disconnects the sub-port 31*c* from the main port 31*d* (second condition).

When the oil pressure applied to the control port 31*b* from the oil pump 20 ascends to a third predetermined value (which is larger than the second predetermined value), the valve spool 32 is moved against the biasing force of the spring 33 so as to locate at a position (shown in FIG. 6) at which the valve spool 32 connects the control port 31*b* and the sub-port 31*c*, but still disconnects both of said ports from the main port 3*d* (third condition).

Figure 7:
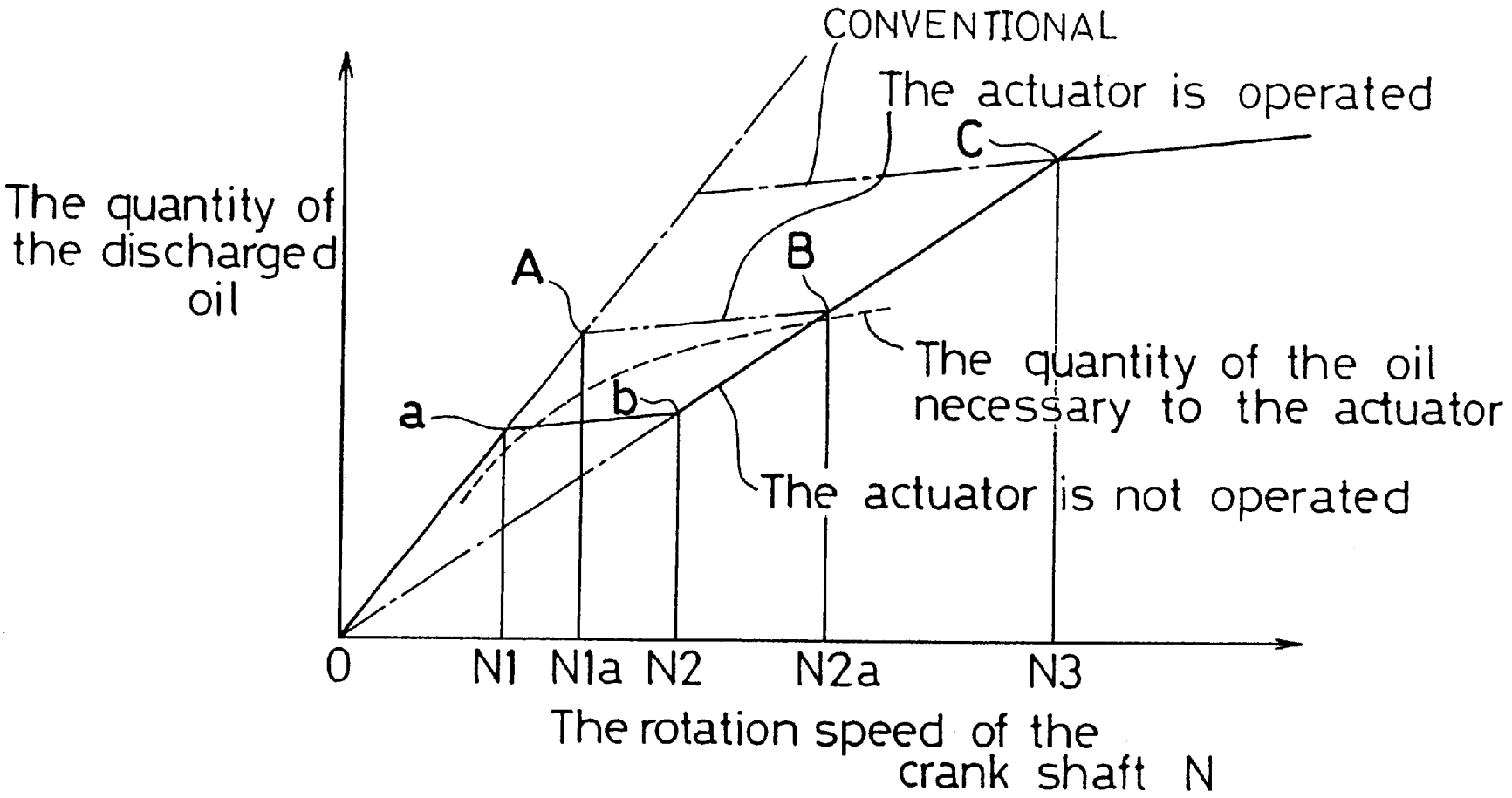
FIG. 7 is a characteristic diagram illustrating the relation between the crank shaft rotational speed and the quantity of the oil pumped out from the pump apparatus of the present invention.

A characteristic diagram of this embodiment of the present invention showing the quantity of the operational oil discharged from the oil pump 20 is shown in FIG. 7. As shown on FIG. 7, the first condition of the control valve 30 corresponds to point "a" or "A", the second condition of the control valve 30 corresponds to point "b" or "B" and the third condition of the control valve 30 corresponds to the condition shown as point "c".

FIG. 7 also illustrates, by a bold dash-single dot-dash line, the amount of oil discharged from a conventional oil pump apparatus (such oil pump apparatus includes an oil pump and a control valve through which flows a portion of the oil pumped out from the oil pump back to a suction port of the oil pump, an oil pan, an oil reservoir, an oil tank and so on in order to reduce the load applied to the oil pump at a medium and high rotation speed range of the oil pump 20.).

Figure 4:
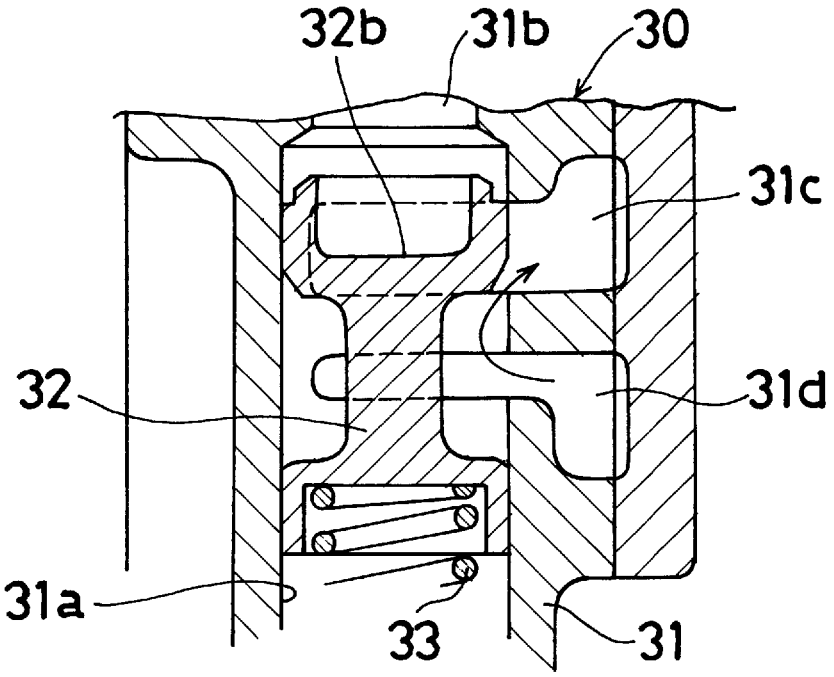
FIG. 4 is an enlarged detailed cross-sectional view illustrating the first condition of the control valve shown in FIG. 2.

In accordance with the above-described embodiment of the present invention, since the valve spool 32 of the control valve 30 is not moved in the downward direction from the position shown in FIG. 4 at a low crank shaft 10 rotation speed between 0 and N1, as shown on FIG. 7 (e.g. 1500 rpm), when the actuator 51 is not operated, the sub-port 31*c* is disconnected from the control port 31*b* but is connected to the main port 31*d*. Therefore, a large amount of operation oil is sucked by the oil pump 20 through both the main suction port 21*c* and the sub suction port 21*d* of the oil pump 20. This is represented in FIG. 7 as a bold line "O~a", which shows the quantity of the operational oil discharged from the oil pump 20 at such low rotation speed. The operational oil is discharged from the oil pump 20 to the components 51, 52 and 53 through the discharge conduit 41.

Figure 5:
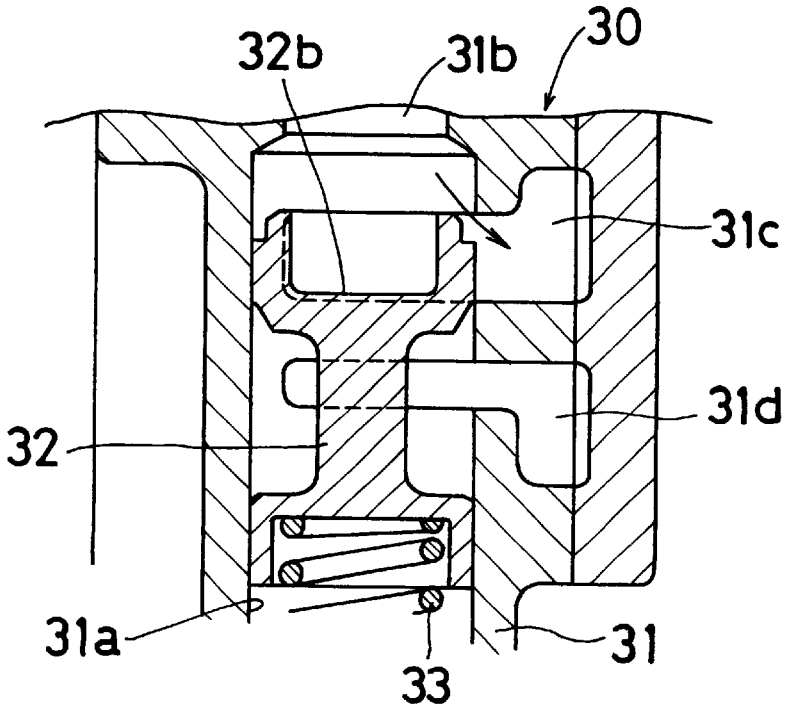
FIG. 5 is an enlarged detailed cross-sectional view illustrating the second condition of the control valve shown in FIG. 2.

Since the valve spool 32 of the control valve 30 is moved between the first and second positions which are shown in FIGS. 4 and 5, respectively, and is not moved further in the downward direction from the position shown in FIG. 5 at a crank shaft 10 rotation speed of between N1 and N2 (e.g. 3000 rpm) when the actuator 51 is not operated, the size of the passages A and B formed between the valve spool 32 and the valve housing 31 which connect the sub-port 31*c* to the control port 31*b* and to the main port 31*d*, respectively, are controlled by the crank shaft 10 rotation speed.

Therefore, a portion of the operational oil which flows into the discharge opening 21*b* from the discharge port 21*e* is made to flow into the sub suction port 21*d* through the control valve 30, and the operational oil is also sucked from the main suction port 21*c* into the sub suction port 21*d*. Consequently, the quantity of the sucked operational oil by the sub suction port 21*d* is restricted in inverse proportion to the oil pressure generated by the oil pump 20, and a sufficient quantity of operational oil is sucked by the main suction port 21*c*. This is shown on FIG. 7 as bold line "a~b", showing the quantity of operational oil discharged from oil pump 20. The operational oil is discharged from the oil pump 20 to the components 51, 52 and 53 through the discharge conduit 41.

Figure 6:
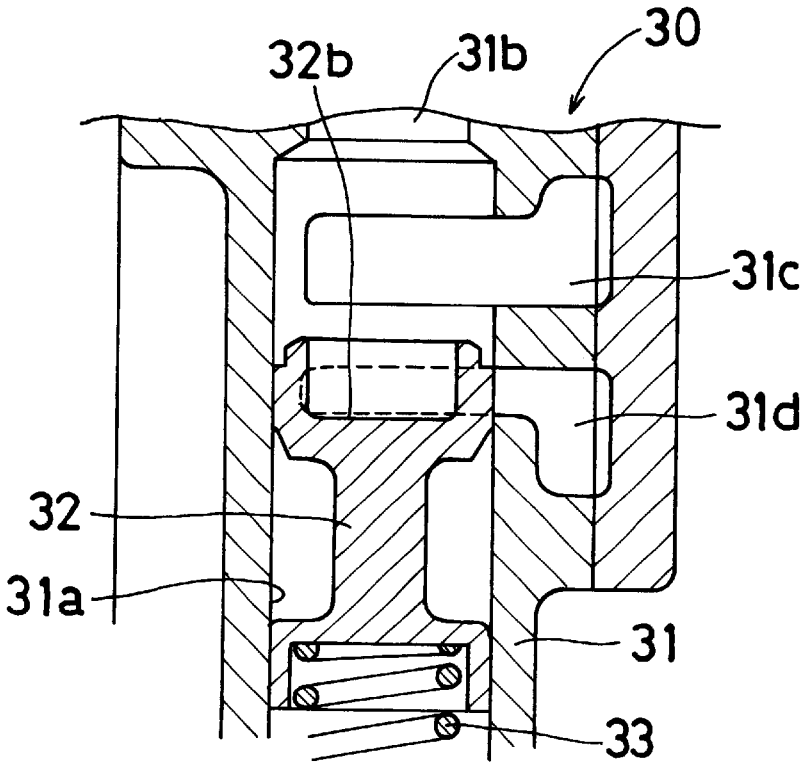
FIG. 6 is an enlarged detailed cross-sectional view illustrating the third condition of the control valve shown in FIG. 2.

Since the valve spool 32 of the control valve 30 is moved between the positions of the second and third conditions, which are shown in FIGS. 5 and 6, respectively, and is not moved in the downward direction from the position shown in FIG. 6 at a crank shaft 10 rotation speed between N2 and N3 (e.g. 5000 rpm) when the actuator 51 is not operated, the sub-port 31*c* is disconnected from the main port 31*d* and the size of passage formed between the valve spool 32 and the valve housing 31 which connects the sub-port 31*c* to the control port 31*b* is controlled such that the size of said passage is in proportion to the crank shaft 10 rotation speed.

Therefore, a portion of the operational oil which flows into the discharge opening 21*b* from the discharge port 21*e* flows into the sub suction port 21*d* through the control valve 30. Consequently, only the main suction port 21*c* sucks the operational oil. This is shown on FIG. 7 as a bold line "b~c", which shows the quantity of the operational oil discharged from the oil pump 20. The operational oil is discharged from the oil pump 20 to the components 51, 52 and 53 through the discharge conduit 41.

Since the valve spool 32 of the control valve 30 is moved in the downward direction from the position shown in FIG. 6 at a high crank shaft 10 rotation speed higher than N3, at such higher speed the control port 31*b* is fully connected to the sub-port 31*c* and the size of passage B formed with the valve spool 32 and the valve housing 31 which connect the main port 31*d* to the control port 31*b* and the sub-port 31*c* is controlled such that the size of said passage is in proportion to the crank shaft 10 rotation speed.

Therefore, a portion of the operational oil which is flows into the discharge opening 21*b* from the discharge port 21*e* flows into both the sub suction port 21*d* and the main suction port 21*c* through the control valve 30. Consequently, the sub suction port 21*d* does not entirely suck the operational oil and the quantity of the sucked operational oil by the main suction port 21*c* is restricted in proportion to the oil pressure generated by the oil pump 20. This is shown on FIG. 7 as a bold line on the right side of point "c", which shows the quantity of operational oil discharged from oil pump 20. The operational oil is discharged from the oil pump 20 to the components 51, 52 and 53 through the discharge conduit 41.

When the actuator 51 is operated, the oil pressure generated by the oil pump 20 is reduced because a portion of the operational oil discharged from the oil pump 20 is consumed by the actuator 51. Therefore, the crank shaft 10 rotation speed at which the valve spool 32 is moved to the position shown in FIG. 4 ascends to N1*a*, as shown in FIG. 7. Furthermore, the crank shaft 10 rotation speed at which the valve spool 32 is moved to the position shown in FIG. 5 ascends to N2*a* as shown in FIG. 7. This is shown on FIG. 7 as a bold line between a–A, and a bold dash-two dot-dash line between A–B, showing the quantity of the operational oil discharged from the oil pump 20 during this stage while the actuator is in operation. Consequently, a quantity of the operational oil larger than that consumed by the actuator 51 (see the characteristic diagram illustrated by a dashed line in FIG. 7) is discharged from the oil pump 20 to the components 51, 52 and 53 through the discharge conduit 41.

Figure 8:
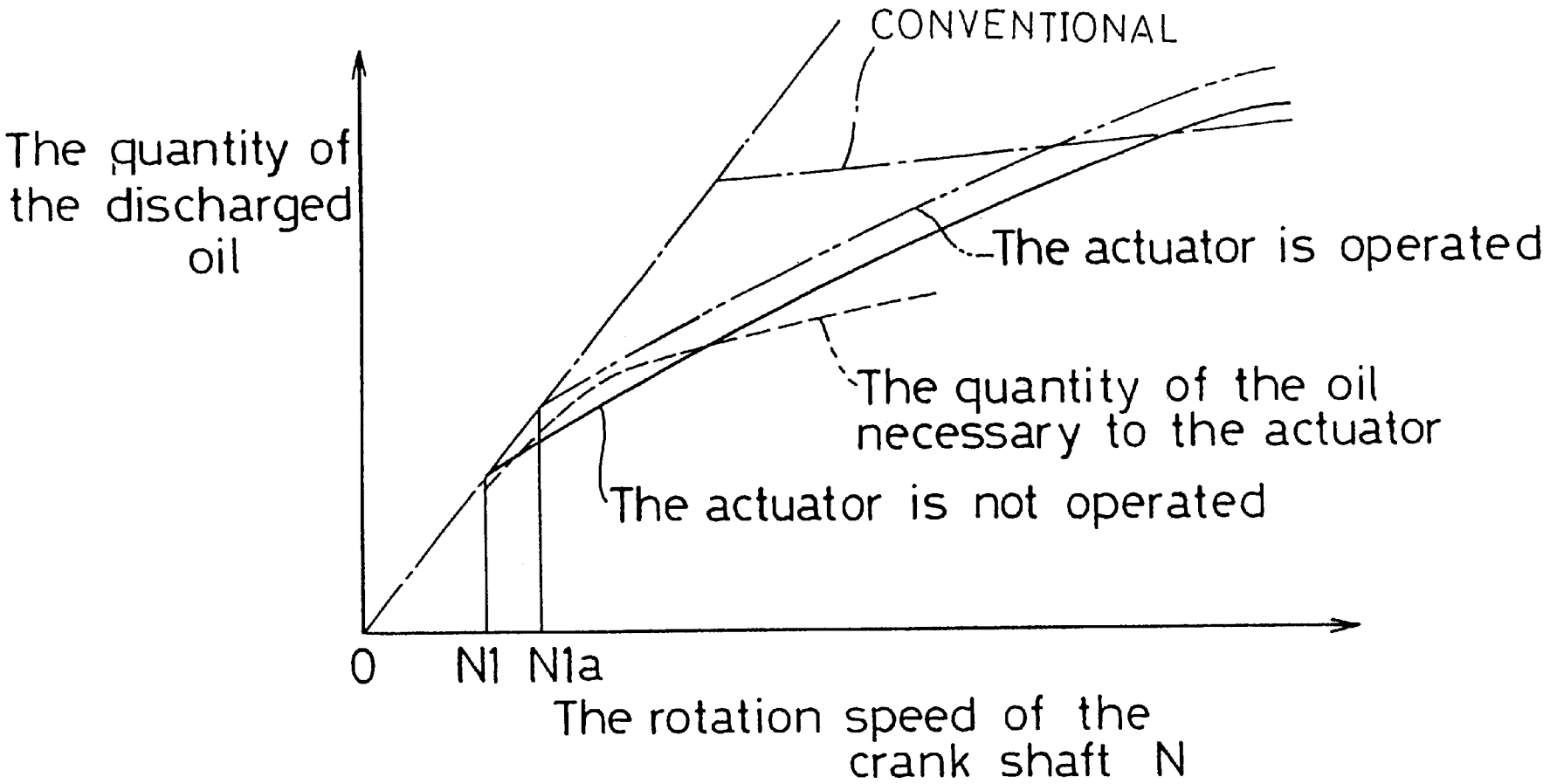
FIG. 8 is a characteristic diagram illustrating the relation between the crank shaft rotational speed and the quantity of the oil pumped out from the pump apparatus of a modification of the first embodiment of the present invention.

In accordance with the present invention, the oil pump apparatus may comprise an oil pump including the suction ports 21*c*, 21*d* constantly connected to each other (a conventional trochoid pump) and a relief valve disposed at the discharge portion of the oil pump, which can be represented by the characteristic diagram shown in FIG. 8, instead of the control valve 30.

In FIG. 8, the relief valve starts to relieve the oil pressure at the crank shaft 10 rotation speed N1 when the actuator is not operated and the relief valve starts to relieve the oil pressure at the crank shaft 10 rotation speed N1*a* when the actuator is operated. Therefore, a quantity of the operational oil smaller than that consumed by the actuator (see a characteristic diagram illustrated by a broken line in FIG. 8) is discharged from the oil pump to the components when the actuator is not operated and the quantity of the operational oil exceeding that consumed by the actuator is discharged from the oil pump to the components when the actuator is operated.

In accordance with the present invention, the oil pump 20 may include a plurality of (more than two) suction ports. In this case, the number of the ports and the number of valve portions of the control valve each have to be increased so as to correspond to the number of the suction ports of the oil pump 20.

In accordance with the present invention, the oil pump apparatus can be applied to any industrial oil farming equipment, and is not restricted to use only with motor vehicle engines. Further, the type of the oil pump and the driving mechanism of the oil pump can be adequately altered to correspond to a wide variety of uses.

Figure 9:
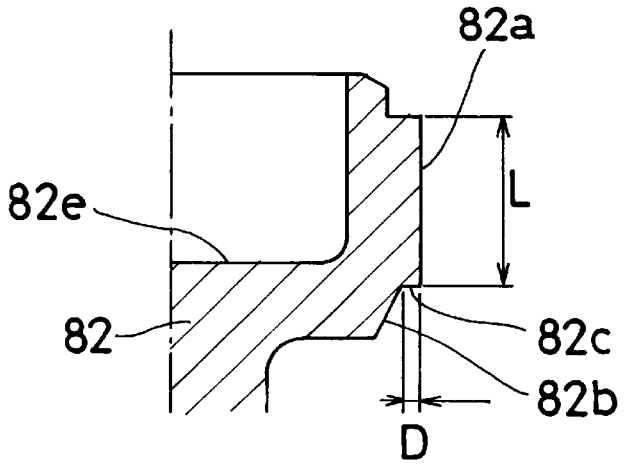
FIG. 9 is an enlarged detail cross-sectional view of the control valve of the second embodiment of the present invention.

A second embodiment of the control valve of the oil pump apparatus of the present invention will be described hereinafter. As shown in FIG. 9, a rand portion 82*a* is disposed at an upper end of the valve spool 82 so as to receive against the end portion 82*e* the oil pressure which is forced from the control port 81*b* to the main port 81*c* at a third control mode (described later). The valve spool 82 has a slope 82*b* (tapered surface) which is sloped from an outer circumferential portion of the rand portion 82*a* towards the axis of the valve spool 82. The slope 82*b* is disposed at a lower portion of the rand portion 82*a* as shown in FIG. 9. Furthermore, the valve spool 82 has a stepped portion 82*c* disposed between the outer circumferential portion of the rand portion 82*a* and the upper end portion of the slope 82*b*.

The control valve 80 has a first control mode (see FIG. 11) at which the sub-port 81*c*, as determined by the amount of oil pressure applied to the control port 81*b*, is only connected to the main port 81*d*. In the second control mode of the control valve 80 (see FIG. 12) the sub-port 81*c* is also connected to the main port 81*d* through the variable restriction portion A. This second control mode provides for the flow of the operational oil into the sub-port 81*c* from both the main port 81*d* and the control port 81*b*. In the third control mode of the control valve 80 (see FIG. 13), the sub-port 81*c* is connected to the control port 81*b* and is also connected to the main port 81*d* through the variable restriction portion B so as to provide for the flow of the operational oil from the control port 81*b* into both the sub-port 81*c* and the main port 81*d*. In the fourth control mode of the control valve 80 (see FIG. 14), the sub-port 81*c* is only connected to the control port 81*b*. In the fifth control mode of the control valve 80 (see FIG. 15), the sub-port 81*c* is connected to the control port 81*b* and the main port 81*d* so as to provide for the flow of the operational oil from the control port 81*b* into both the sub-port 81*c* and the main port 81*d*.

Figure 10:
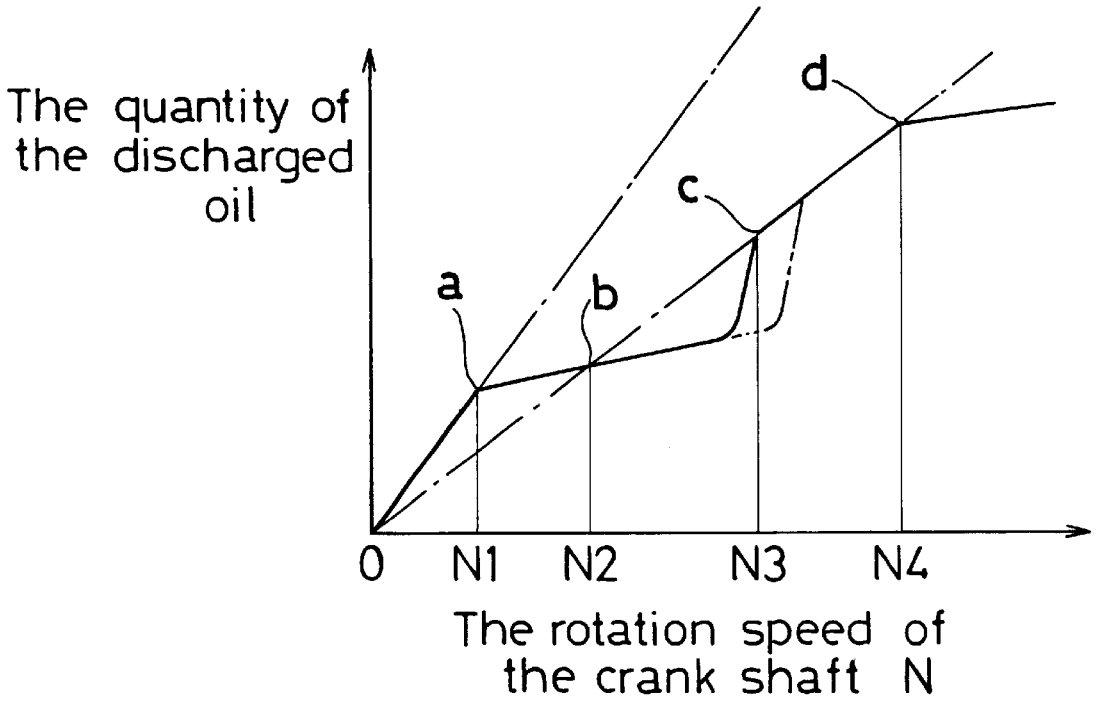
FIG. 10 is a characteristic diagram illustrating the relation between the crank shaft rotational speed and the quantity of the oil pumped out from the pump apparatus of the second embodiment of the present invention.

The operation of the control valve 80 of the second embodiment of the present invention may be represented by a characteristic diagram of the quantity of the operational oil discharged from the oil pump 20, as shown in FIG. 10. The first control mode is illustrated as a diagram "O~a", the second control mode is illustrated as a diagram "a~b", the third control mode is illustrated as a diagram "b~c", the fourth control mode is illustrated as a diagram "c~d" and the fifth control mode is shown as a bold line on the right side of "d".

Figure 11:
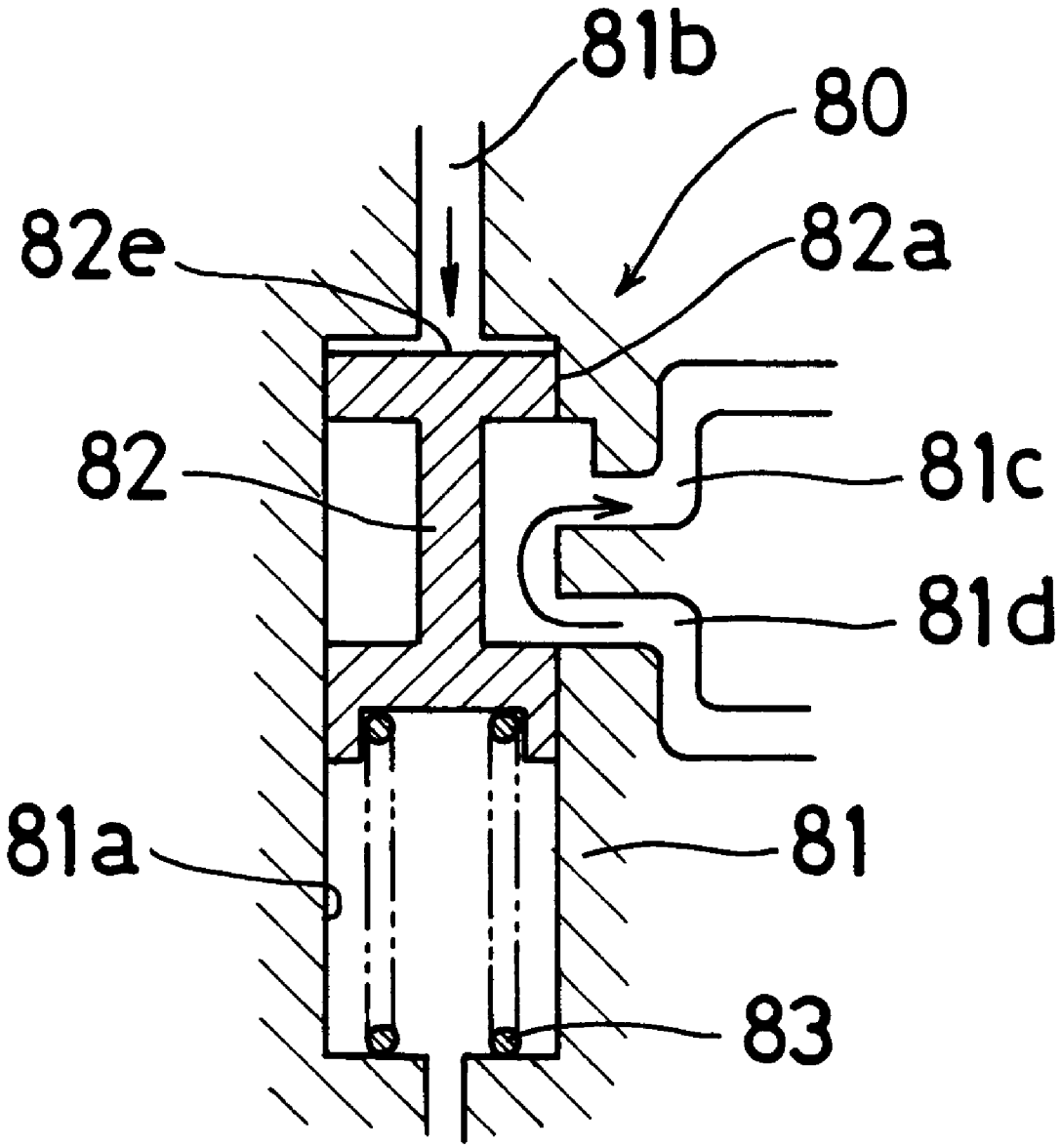
FIG. 11 is a schematic cross-sectional view illustrating the operation of the first control mode of the control valve shown in FIG. 9.

In accordance with the above embodiment of the present invention, since the valve spool 82 of the control valve 80 is located at a position schematically shown in FIG. 11 at a rotation speed range of the crank shaft 10 between 0 and N1, the sub-port 81*c* is disconnected from the control port 81*b* and is connected to the main port 81*d*. Therefore, a relatively large amount of operational oil is sucked by the oil pump 20 through both the main suction port 21*c* and the sub suction port 21*d* of the oil pump 20. This is shown as a line "O~a" in FIG. 10, which shows the amount of operational oil discharged by the oil pump 20. The operational oil is discharged from the oil pump 20 to the components 51, 52 and 53 through the discharge conduit 41.

Figure 12:
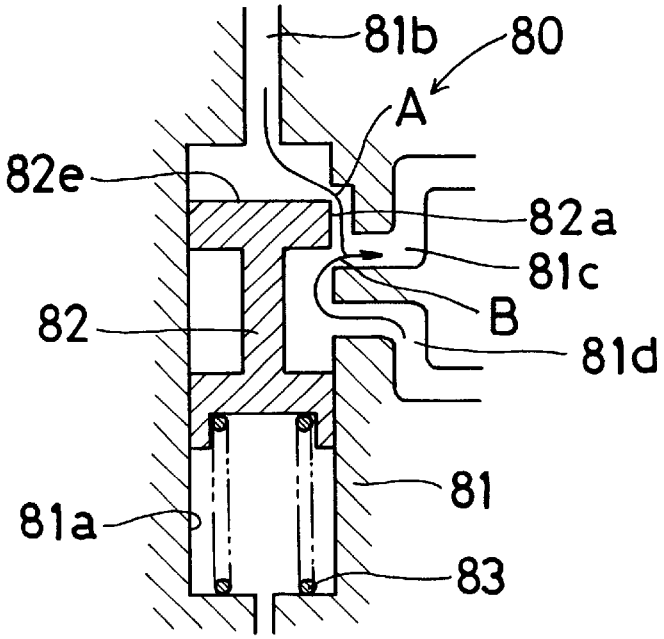
FIG. 12 is a schematic cross-sectional view illustrating the operation of the second control made of the control valve shown in FIG. 9.

Since the valve spool 82 of the control valve 80 is located at a position schematically shown in FIG. 12 at a crank shaft 10 rotation speed between N1 and N2, the sub-port 81*c* is connected to the main port 81*d* (whereby a relatively small quantity of the operational oil flows into the sub-port 81*c* from the main port 81*d* due to the flow restriction imposed by the variable restriction portion B) and the quantity of the operational oil which flows into the sub-port 81*c* from the control port 81*b* is controlled by the variable restriction portion A in inverse proportion to the crank shaft 10 rotation speed (restriction portion A is pushed open in proportion to the amount of oil pressure). When the valve spool 82 is in this position, the operational oil flows into the sub-port 81*c* from the main port 81*d* and the control port 81*b*.

Therefore, a portion of the operational oil which flows into the discharge opening 21*b* from the discharge port 21*e* flows into the sub suction port 21*d* through the control valve 80 and the operational oil is also sucked from the main suction port 21*c* into the sub suction port 21*d*. Consequently, the quantity of the operational oil sucked by the sub suction port 21*d* is restricted in proportion to the quantity of the operational oil flowed into the sub-port 81*c* from the control port 81*b* through the variable restriction portion A, and a sufficient quantity of operational oil is sucked by the main suction port 21*c*. This may be represented by a characteristic diagram of the quantity of the operational oil discharged from the oil pump 20, which is shown as a line "a~b" in FIG. 10. Thus, the load applied to the oil pump 20 is reduced by the restriction of the quantity of the operational oil which is sucked by the sub suction port 21*d*.

Figure 13:
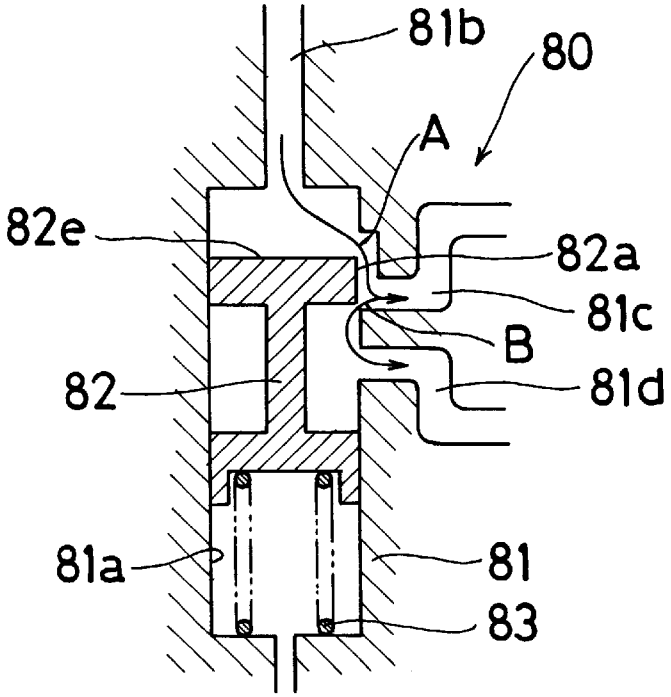
FIG. 13 is a schematic cross-sectional view illustrating the operation of the third control mode of the control valve shown in FIG. 9.

Since the valve spool 82 of the control valve 80 is located at a position schematically shown in FIG. 13 at a crank shaft 10 rotation speed between N2 and N3, the sub-port 81*c* is connected to the control port 81*b* (whereby a relatively small quantity of the operational oil flows into the sub-port 81*c* from the control port 81*b* due to the restriction imposed by the restriction portion A), and the quantity of the operational oil flowing into the main port 81*d* from the control port 81*b* is controlled by the restriction portion B due to the amount of restriction imposed by restriction proportion B which varies in proportion to the crank shaft 10 rotation speed. Thus, the operational oil flows into the sub-port 81*c* and the main port 81*d* from the control port 81*b*.

Therefore, a portion of the operational oil which flows into the discharge opening 21*b* from the discharge port 21*e* flows into the sub suction port 21*d* and the main suction port 21*c* through the control valve 80. Consequently, the sub suction port 21*d* sucks a relatively small quantity of operational oil and the quantity of the sucked operational oil by the main suction port 21*c* is restricted in proportion to the quantity of the operational oil flowed into the main port 81*d* from the control port 81*b* through the variable restriction portion B. This operation of the oil pump apparatus is shown as a line "b~c" in FIG. 10, which shows the quantity of oil discharged by the oil pump 20. Therefore the load applied to the oil pump 20 is reduced by the restriction of the quantity of the operational oil which is sucked by the sub suction port 21*d* and the main suction port 21*c*.

Figure 14:
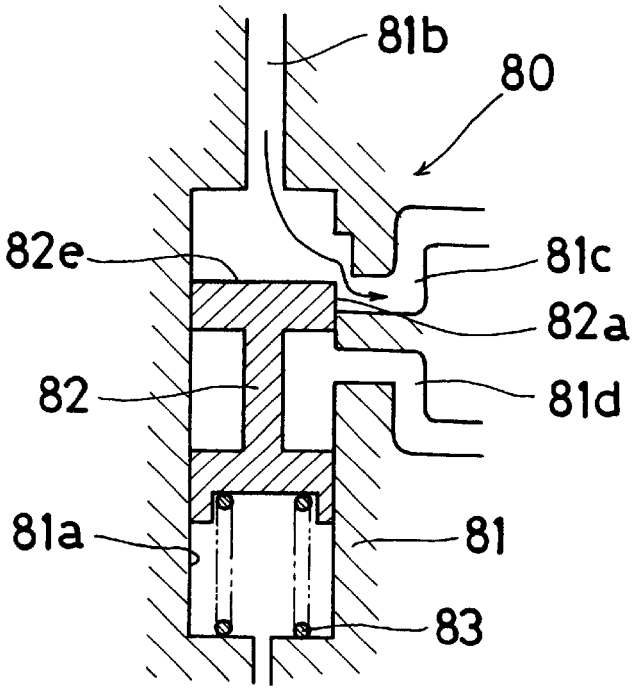
FIG. 14 is a schematic cross-sectional view illustrating the operation of the fourth control mode of the control valve shown in FIG. 9.

In this second embodiment of the present invention, when the valve spool 82 of the control valve 80 is located at a position schematically shown in FIG. 14, which occurs at a crank shaft 10 rotation speed between N3 and N4, the sub-port 81*c* is connected to the control port 81*b* and disconnected from the main port 81*d*. When the valve spool 82 is in this position, the operational oil flows into the sub-port 81*c* from the control port 81*b*, but said oil cannot flow into the main port 81*d* from the control port 81*b*.

Therefore, a portion of the operational oil flowing into the discharge opening 21*b* from the discharge port 21*e* flows into the sub suction port 21*d* through the control valve 80 and none of said oil flows into the main suction port 21*c*. Consequently, the main suction port 21*c* sufficiently sucks the operational oil and the sub suction port 21*d* scarcely sucks the operational oil. This is shown on FIG. 10 as line "c~d" in FIG. 10, which represents the quantity of oil discharged from oil pump 20. Therefore the load applied to the oil pump 20 is reduced by the restriction of the quantity of the operational oil which is sucked by the sub suction port 21*d*.

Figure 15:
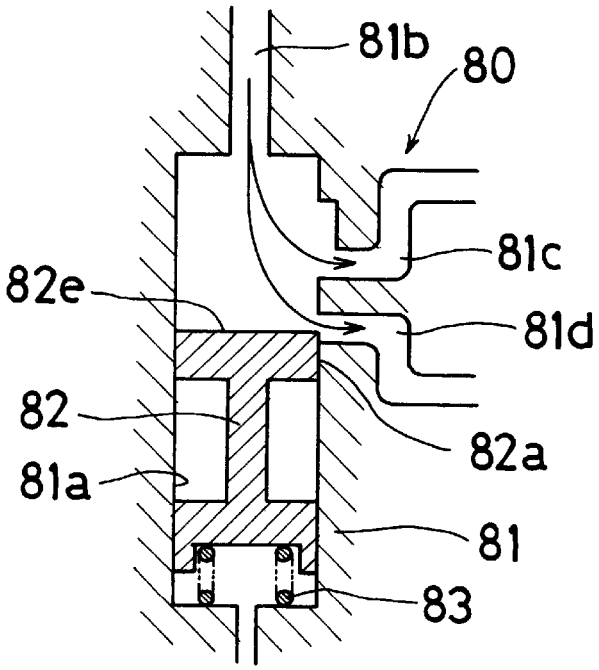
FIG. 15 is a schematic cross-sectional view illustrating the operation of the fifth control mode of the control valve shown in FIG. 9.

When the valve spool 82 of the control valve 80 is located at a position schematically shown in FIG. 15, which occurs at a crank shaft 10 rotation speed higher than N4, the control port 81*b* is fully connected to the sub-port 81*c* and the quantity of the operational oil flowed into the main port 81*d* from the control port 81*b* is controlled by the variable restriction portion A, such that the amount of restriction imposed by restriction portion B is in inverse proportion to the crank shaft 10 rotation speed. In this position, the operational oil flows into both the sub-port 81*c* and the main port 81*d* from the control port 81*b*.

Therefore, a portion of the operational oil which flows into the discharge opening 21*b* from the discharge port 21*e* flows into the sub suction port 21*d* and the main suction port 21*c* through the control valve 80. Consequently, the sub suction port 21*d* scarcely sucks the operational oil and the quantity of the sucked operational oil by the main suction port 21*c* is restricted in proportion to the quantity of the operational oil flowed into the main port 81*d* from the control port 81*b* through the variable restriction portion A. This is shown on FIG. 10 as line to the right side of point "d". Therefore the load applied to the oil pump 20 is reduced by the reduction of the quantity of the operational oil which is sucked by the sub suction port 21*d* and the main suction port 21*c*.

In accordance with the above embodiment of the present invention, since the oil pressure generated at a lower portion of the slope 82*b* (shown in FIG. 9) is smaller than that generated at the variable restriction portion B, a the amount of force applied to the valve spool 82 by the oil pressure in the same direction as the force applied by the spring 83 to the valve spool 82 is reduced. Therefore, the increasing characteristic of the quantity of the operational oil discharged by the oil pump 20 at the third control mode is close to the decreasing characteristic (the hysterisis is small), so that the efficiency of the oil pump apparatus is relatively stable.

Figure 16:
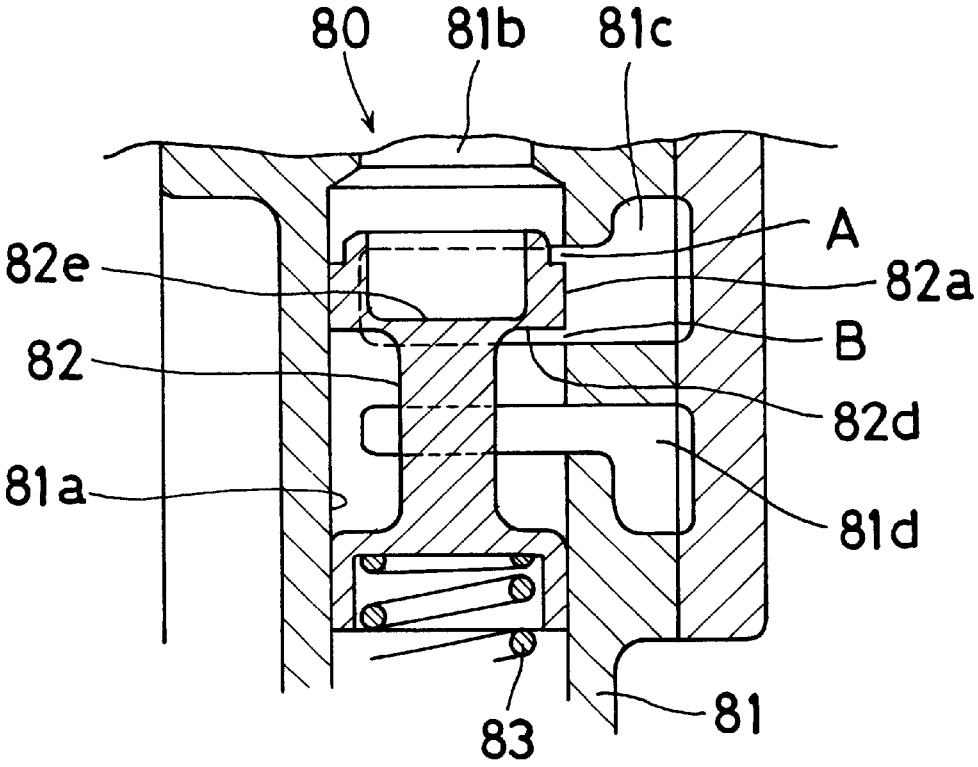
FIG. 16 is an enlarged detailed cross-sectional view illustrating the control valve which does not include a slope on the valve spool corresponding to FIG. 3.

When the rand portion 82*a* does not include a slope 82*b,* as shown in FIG. 16, a comparatively high amount of oil pressure generated at the variable restriction portion B is applied to the underside surface 82*d* so as to strongly bias the valve spool 82 in the same direction as the spring 83 forces the valve spool 82. Therefore, the oil pressure which acts to force the valve spool 82 in a downward direction, when measured at the time when the restriction portion B becomes closed, becomes higher so that the characteristic diagram of the quantity of the operational oil discharged by the oil pump 20 at the third control mode is illustrated as a two dotted line in FIG. 10, which shows a higher hysteresis.

In accordance with the second embodiment of the present invention, because the stepped portion 82*c* extending in the radial direction of the valve spool 82 is formed between the outer circumferential portion of the rand portion 82*a* and the upper end portion of the slope 82*b,* a size L of the rand portion 82*a* (shown in FIG. 9) in the axial direction of the valve spool 82 can be prevented from being varied by any manufacturing variation of the slope 82*b,* in order to maintain stable efficiency of the oil pump apparatus. Further, a size D of the stepped portion 82*c* should be preferably small in order to reduce the hysteresis with respect to the quantity of the operational oil discharged by the oil pump 20.

Figure 17:
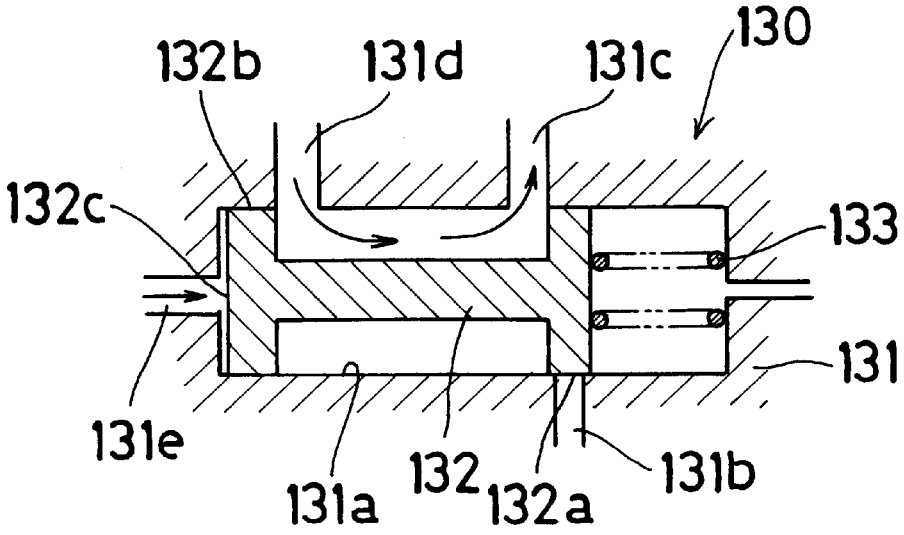
FIG. 17 is a schematic cross-sectional view illustrating the operation of the first control mode of the control valve of the oil pump apparatus of the third embodiment of the present invention.
Figure 18:
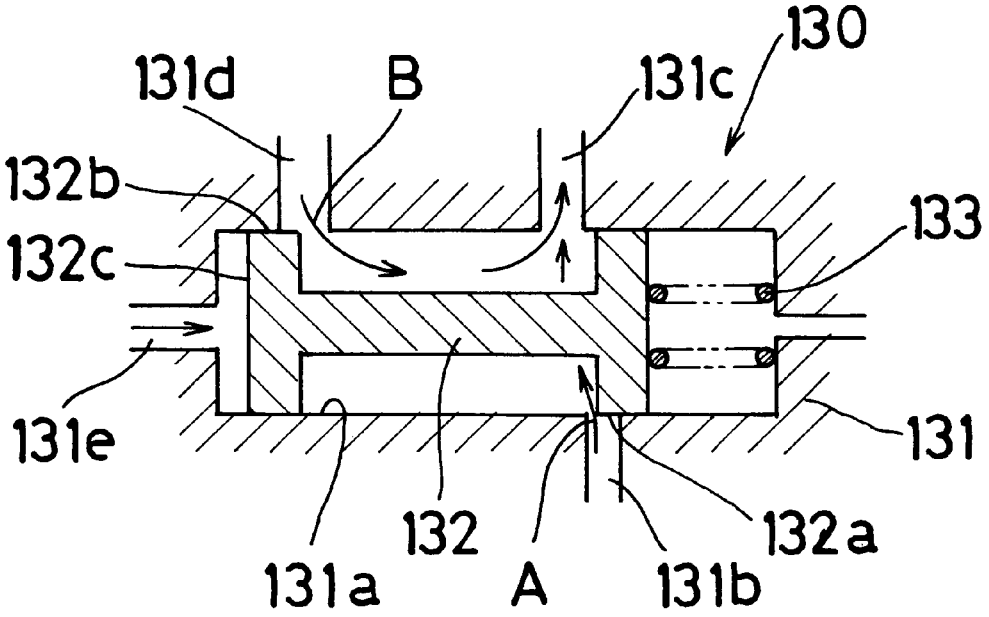
FIG. 18 is a schematic cross-sectional view illustrating the operation of the second control mode of the control valve of the oil pump apparatus of the third embodiment of the present invention.
Figure 19:
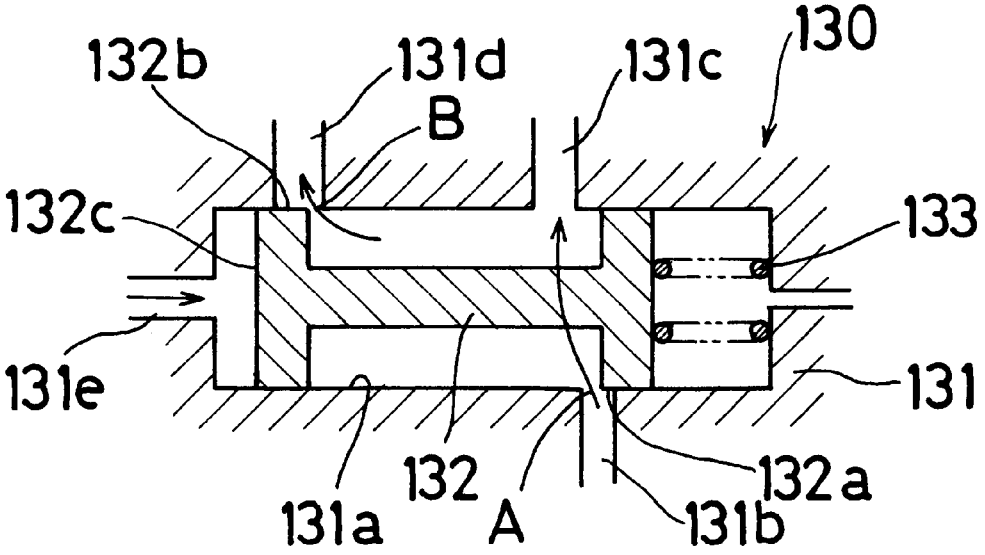
FIG. 19 is a schematic cross-sectional view illustrating the operation of the third control mode of the control valve of the oil pump apparatus of the third embodiment of the present invention.
Figure 20:
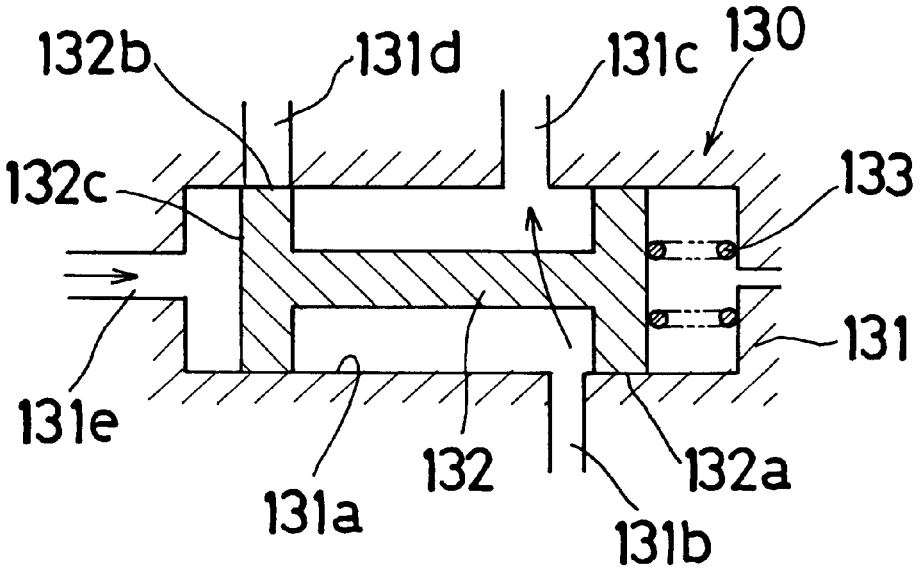
FIG. 20 is a schematic cross-sectional view illustrating the operation of the fourth control mode of the control valve of the third embodiment of the present invention.
Figure 21:
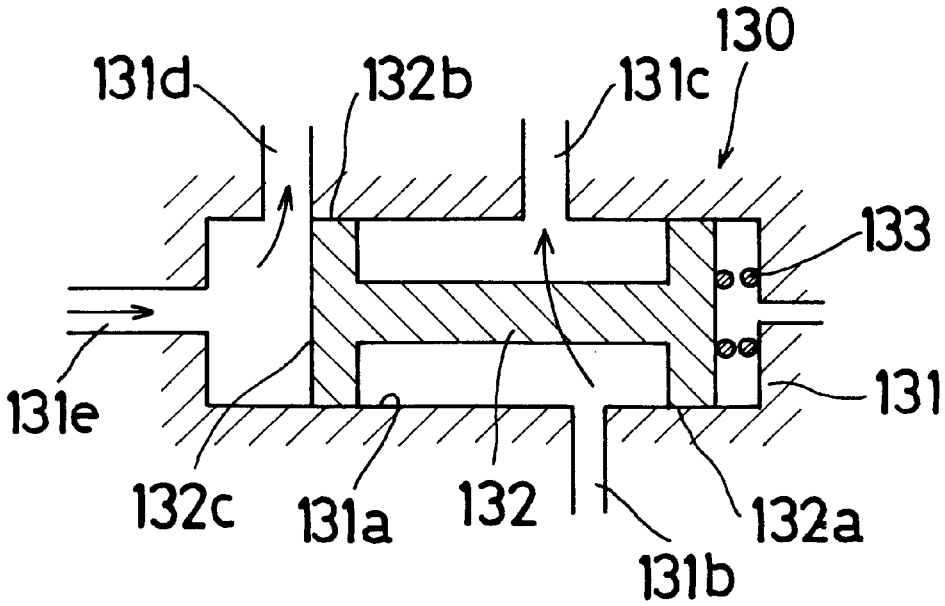
FIG. 21 is a schematic cross-sectional view illustrating the operation of the fifth control mode of the control valve of the third embodiment of the present invention.

The control valve of the oil pump apparatus of the third embodiment of the present invention (shown in FIGS. 17 to 21) will be described hereinafter. The control valve 130 includes a valve housing having a cylinder 131*a,* a first control port 131*b,* a sub-port 131*c,* a main port 131*d* and a second control port 131*e.* The control valve 130 includes a valve spool 132 slidably disposed in the cylinder 131*a* and to which an oil pressure generated by the oil pump 20 is applied through the second control port 131*e* (shown in FIG. 17) so as to control a connection between the ports 131*b,* 131*c,* 131*d* and 131*e.* The control valve 130 further includes a spring 133 biasing the valve spool 132 in the left direction, as shown in FIG. 17. The valve spool 132 includes variable restriction portions A and B between the valve spool 132 and the valve housing 131 and an and portion 132*c* against which the oil pressure is applied.

The control ports 131*b,* 131*e* are constantly connected to the discharge port 21*e,* the sub-port 131*c* is constantly connected to the subsuction port 21*d,* and the main port 131*d* is constantly connected to the main suction port 21*c* of the oil pump 20.

In this embodiment, the control valve 130 has a first control mode (see FIG. 17) at which the sub-port 131*c* is only connected to the main port 131*d.* In the second control mode (see FIG. 18), the sub-port 131*c* is connected to the main port 131*d* through a semi-restricted position of the variable restriction portion B, and the sub-port 131*c* is also connected to the first control port 131*b* through a relatively highly restricted position of the variable restriction portion A, so that the operational oil flows into the sub-port 131*c* from both the main port 131*d* and the first control port 131*b.* In the third control mode (see FIG. 19), the sub-port 131*c* is connected to the first control port 131*b* and the sub-port 131*c* is connected to the main port 131*d* through the variable restriction portion B so that the operational oil flows from the first control port 131*b* into both the sub-port 131*c* and the main port 131*d.* In the fourth control mode (see FIG. 20), the sub-port 131*c* is only connected to the first control port 131*b.* Finally, in the fifth control mode (see FIG. 21), the sub-port 131*c* is connected to the first control port 131*b,* and the second control port 131*e* is connected to the main port 131*d.* In this fifth control mode the operational oil from the first control port 131*b* into the sub-port 131*c,* and the operational oil also flows from the second control port 131*e* into the main port 131*d.*

A characteristic diagram showing the quantity of the operational oil discharged from the oil pump 20 with respect to this third embodiment of the present invention is shown in FIG. 10. Because the operation of the control valve 130 is substantially equivalent to that of the control valve 80, further description of said operation is omitted herein.

While the invention has been particularly shown and described with reference to the preferred embodiments thereof, it will be understood by those skilled in the art that the foregoing and other changes in form and details can be made therein without departing from the spirit and scope of the invention.

What is claimed is:

1. An oil pump apparatus comprising:

an oil pump for being driven by a driving source and for being connected to a component to which an oil is supplied from the oil pump; and a control valve for preventing the oil which is unnecessary to the component from flowing into the component;

wherein the oil pump includes a suction opening, a discharge opening, a discharge port constantly connected to the discharge opening, a main suction port constantly connected to the suction opening and a sub suction port selectively connected to or disconnected from the suction opening and selectively connected to or disconnected from the discharge opening through the control valve, and the main suction port is located next to the sub suction port in the rotational direction of the oil pump so that the unnecessary oil is sucked through the sub suction port and the main suction port in series.

2. An oil pump as claimed in claim 1, wherein the control valve includes a control port into which the discharged oil flows from the oil pump, a main port constantly connected to the main suction port, a sub-port constantly connected to the sub suction port, a valve housing having a cylinder connected to the main port and sub-port, and a valve spool slidably disposed in the cylinder and a spring biasing the valve spool in an axial direction of the valve spool, the valve spool receiving the oil pressure discharged from the oil pump at one end thereof.

3. An oil pump as claimed in claim 2, wherein the control valve has a first control mode at which the sub-port is only connected to the main port, a second control mode at which the sub-port is connected to the main port and the sub-port is connected to the control port so as to flow the oil into the sub-port from the main port and the control port, a third control mode at which the sub-port is connected to the control port and the sub-port is connected to the main port so as to flow the oil into the main port and the sub-port from the control port, and a fourth control mode at which the sub-port is only connected to the control port.

* * * * *

UNITED STATES PATENT AND TRADEMARK OFFICE

CERTIFICATE OF CORRECTION

PATENT NO. : 6,247,904 B1
DATED : June 19, 2001
INVENTOR(S) : Miyazaki et al.

It is certified that error appears in the above-identified patent and that said Letters Patent is hereby corrected as shown below:

Title page,
Item [30], Foreign Application Priority Data, please delete "9-11148" and add -- 9-111489 --, and please delete "9-13145" and add -- 9-131457 --.

Signed and Sealed this

Fifteenth Day of January, 2002

*Attest:*

*Attesting Officer*

JAMES E. ROGAN
*Director of the United States Patent and Trademark Office*